US005584734A

United States Patent [19]

Ogino et al.

[11] Patent Number: 5,584,734

[45] Date of Patent: Dec. 17, 1996

[54] LOWER-UNIT FOR MARINE OUTBOARD DRIVE

[75] Inventors: Hiroshi Ogino; Takashi Iwashita, both of Hamamatsu, Japan

[73] Assignee: Sanshin Kogyo Kabushiki Kaisha, Hamamatsu, Japan

[21] Appl. No.: 502,674

[22] Filed: Jul. 14, 1995

[30] Foreign Application Priority Data

Jul. 15, 1994 [JP] Japan ..... 6-163560

[51] Int. Cl.[6] ..... B63H 5/07

[52] U.S. Cl. ..... 440/79

[58] Field of Search ..... 440/78, 75, 79, 440/900

[56] References Cited

U.S. PATENT DOCUMENTS 4,810,218 3/1989 Iwai ..... 440/66

4,832,635 5/1989 McCormick ..... 440/78

4,898,553 2/1990 Bankstahl ..... 440/78

*Primary Examiner*—Jesus D. Sotelo

*Attorney, Agent, or Firm*—Knobbe, Martens, Olson & Bear

[57] ABSTRACT

A lower unit of a marine outboard drive has a unique shape which inhibits boundary layer separation within the water flow stream over the lower unit regardless of the trim position of the lower unit. The lower unit includes a nacelle. The front nose of the nacelle blends smoothly into a supporting strut in a vertical direction to form a generally teardrop-like cross-sectional shape. The front end of the strut fairs the nacelle body from its sharp leading edge to give the lower unit a streamline shape at trim angles approaching a full trim up position of the lower unit. The leading edge of the strut also slopes rearward away from the front nose of the nacelle. The shape of this junction between the upper side of the nacelle and the strut front end gives the front end of the lower unit a generally constant streamline shape as the lower unit rotates through a range of trim angle positions.

28 Claims, 9 Drawing Sheets

LOWER-UNIT FOR MARINE OUTBOARD DRIVE

BACKGROUND OF THE INVENTION

1. Field of the Invention

The present invention relates to a marine propulsion system. In particular, the present invention relates to a lower unit design of an outboard drive.

2. Description of Related Art

Lower units of outboard motors commonly house a transmission or a like drive transfer mechanism beneath the water surface of the body of water in which the outboard motor is operated. The drive transfer mechanism in the lower unit transfers power from a drive shaft of the outboard motor to at least one propulsion shaft. The propulsion shaft in turn drives a propulsion device, such as, for example, a propeller.

Prior lower units generally include a housing or nacelle which houses the drive transfer mechanism. The nacelle generally has a cone-like shape with a blunt, rounded nose (i.e., generally has a bullet-like shape). Such prior configurations present a streamline shape when the axis of the propeller shaft lies generally parallel to the direction of water flow over the lower unit. The streamline shape inhibits boundary layer separation within the water stream over the lower unit to minimize water resistance (i.e., drag) on the lower unit.

The lower unit, however, desirably does not remain in one position for all operation conditions. Rather, the position of the propeller shaft relative to the horizontal (i.e., the trim angle) desirably changes depending upon the running condition of the watercraft. For instance, when running at high speed, the propeller is trimmed up (i.e., "trimmed out," away from the watercraft transom) to position the propeller shaft at a positive trim angle relative to the horizontal. The positive trim position of the propeller shaft maintains the planing condition of the watercraft with the bow of the watercraft riding out of the water.

SUMMARY OF THE INVENTION

The present invention includes the recognition that prior lower unit configurations do not present a streamline shape when trimmed to a large trim angle (i.e., at or near a full trim up position). The nacelle loses its streamline shape as it pivots up from a full trim down position. The failure to present a streamline shape increases water resistance on the lower unit. In addition, because the lower unit commonly is trimmed up when running at high speeds, the increased drag due to the complicated, non-streamline shape of the nacelle in the trim up position is exacerbated under this running condition. Drag increases proportionately with velocity.

Thus, one aspect of the present invention involves a lower unit of a marine outboard drive capable of pivoting about a lateral axis to adjust a trim position of the outboard drive between a full trim up position and a full trim down position. The lower unit has a shape which presents a substantially streamline shape in the direction of water flow over the lower unit with the lower unit position in both the full trim up position and the full trim down position.

In accordance with another aspect of the present invention, a lower unit of a marine outboard drive comprises a nacelle having a longitudinal axis. The lower unit is capable of pivoting between at least a full trim up position and a full trim down position such that a direction of water flow relative to the longitudinal axis changes as the lower unit pivots. The lower unit has a front end which is shape so as to maintain a substantially streamline shape relative to the direction of water flow as the lower unit moves between the full trim up position and the full trim down position.

An additional aspect of the present invention involves a lower unit of a marine outboard drive which is adapted to pivot about a lateral axis to establish a trim position of the lower unit. The lower unit includes a nacelle suspended by a strut into a body of water in which the outboard drive is operated. The lower unit also includes means for inhibiting boundary layer separation within a water flow stream over the nacelle and behind an apex of the nacelle.

BRIEF DESCRIPTION OF THE DRAWINGS

These and other features of the invention will now be described with reference to the drawings of a preferred embodiment which is intended to illustrate and not to limit the invention, and in which.

DETAILED DESCRIPTION OF A PREFERRED EMBODIMENT

Figure 1:
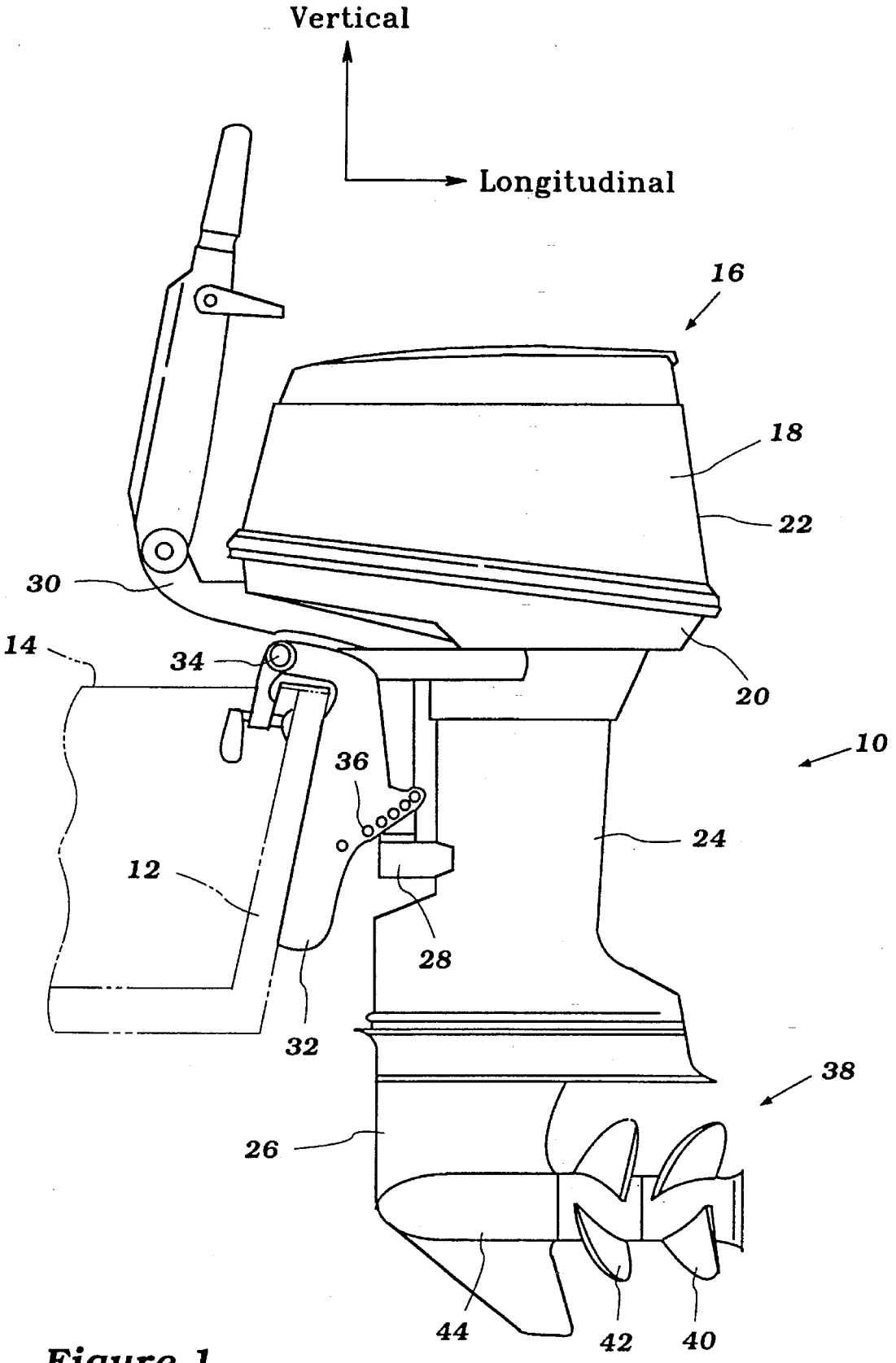
Figure 1 Prior Art
FIG. 1 is a side elevational view of a marine outboard motor which can embody either the prior or present lower unit design.

FIG. 1 illustrates a marine outboard drive of the type in which the present lower unit design can be incorporated. In the illustrated embodiment, the outboard drive 10 is depicted as an outboard motor for mounting on a transom 12 of a watercraft 14. It is contemplated, however, that those skilled in the art will readily appreciate that the present lower unit design can be used with stern drive units of inboard-outboard motors and with other types of watercraft drive units as well. Thus, as used herein, "outboard drive" is meant to includes these various types of marine propulsion systems.

In the exemplary embodiment, the outboard drive 10 has a power head 16 which includes an internal combustion engine of any known type. A conventional cowling 18 surrounds the engine. The cowling 18 desirably includes a lower tray 20 and a top cowling member 22. These components 20, 22 of the protective cowling 18 together define an engine compartment which houses the engine.

The engine is mounted conventionally with its outward shaft (i.e., a crankshaft) rotating about a generally vertical axis. The crankshaft drives a drive shaft which depends from the power head 16 of the outboard drive 10, as known in the art.

A drive shaft housing 24 extends downward from the lower tray 20 and terminates in a lower unit 26. The drive shaft engine extends through and is journaled within the drive shaft housing 24, as known in the art.

As seen in FIG. 1, a steering bracket 28 is attached to the drive shaft housing 24 in a known manner. A conventional steering shaft or handle 30 is affixed to the drive shaft housing 24 to move the outboard drive 10 for steering purposes.

The steering bracket 28 also is pivotable connected to a clamping bracket 32 by a pin 34. The clamping bracket 32, in turn, is configured to attach to the transom 12 of the watercraft 14. This conventional coupling permits the outboard drive 10 to be pivoted relative to the pin 34 to permit adjustment to the trim position of the outboard drive between a full trim down position (illustrated in FIG. 1) and a full trim up position. The trim position of the outboard drive 10 desirably can be set at any position between the full trim up and full trim down positions. This pivotable coupling also allow for tilt up of the outboard drive 10 for storage purposes, as known in the art.

As seen in FIG. 1, the clamping bracket 32 can include a trimming mechanism 36 in order to maintain a desired trim position of the outboard motor 10. And although not illustrated, it also is understood that a conventional hydraulic tilt and trim cylinder assembly can be used in the alternative with the present outboard drive 10 in order to adjust the trim position of the lower unit according to the running condition of the watercraft 14, as known in the art.

The lower unit 24 houses a transmission (not shown) which selectively establishes a driving condition of a propulsion device 38, such as, for example, a propeller, a hydrodynamic jet, or the like. The transmission advantageously is a forward-neutral-reverse type transmission. The transmission specifically couples the drive shaft, which is driven by the engine, with at least one propeller shaft which extends to the rear of the lower unit 26 and drives the propulsion drive 38. In this manner, the propulsion device can drive the watercraft in any of these three operating states.

In the illustrated embodiment, the transmission selectively couples the drive shaft to a counter-rotational propulsion device 38. The propulsion device 38 includes a rear or aft propeller 40 designed to spin in one direction and to assert a forward thrust, and a front propeller 42 designed to spin in an opposite direction and to assert a forward thrust. The present lower unit can, of course, be used with other types of propulsion devices.

In order to further an appreciation of the present invention, the following first describes a conventional lower unit design in detail before describing the present embodiment of the lower unit. FIGS. 2 through 7 illustrate a prior lower unit design and FIGS. 8 through 13 illustrate the present lower unit design.

For the purpose of describing the prior and present lower units, a coordinate system is provided, as partially seen in FIG. 1, having mutually orthogonal coordinates oriented as follows: a "longitudinal" coordinate extend in the direction between the bow and the stern of the watercraft 12; a "lateral" coordinate extending in the direction between the port and starboard sides of the watercraft 12; and a vertical coordinate extending orthogonal to both the longitudinal and lateral coordinates. In addition, as used herein, "forward" and "rearward" refer to the direction toward or away from the bow, respectively, in the direction of the longitudinal coordinate.

The shape of the prior and present lower units also will be discussed at various trim angle positions. In this regard, the following definitions are provided. The "trim angle" position of the lower unit 26 is taken in reference to the horizontal, i.e., the surface of the body of water in which the outboard drive 10 is operated. That is, as used herein, the "trim angle" is an angle formed between a longitudinal axis of the propeller shaft housed within the lower unit and the horizontal. In the full trim down position, the trim angle is zero as the propeller shaft axis lies parallel to the horizontal. In the full trim up position, the propeller shaft is skewed relative to the horizontal by a given degree. A "small trim angle" is close to the full trim down position and a "large trim angle" is approaching the full trim up position.

Figure 2:
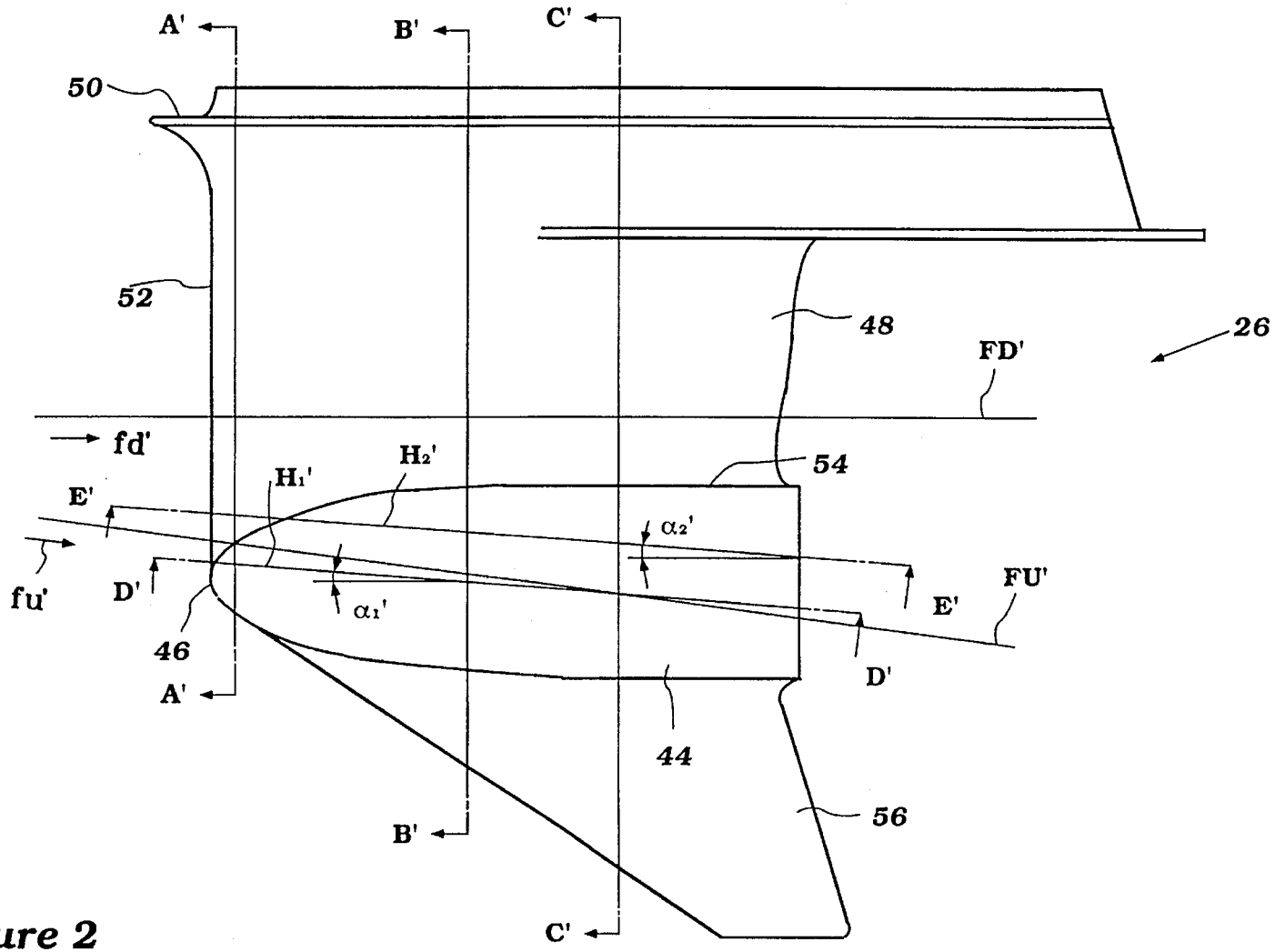
Figure 2 Prior Art
FIG. 2 is an enlarged side elevational view of a prior lower unit of the marine outboard motor of FIG. 1 in isolation.

With reference to FIG. 2, the conventional lower unit 26 includes a nacelle 44 which houses the transmission and propulsion shafts coupled to the front and rear propellers 40, 42. As understood from FIGS. 2–5, the nacelle has a generally cone shape with a circular front nose 46 (see FIGS. 3 and 6).

Figure 3:
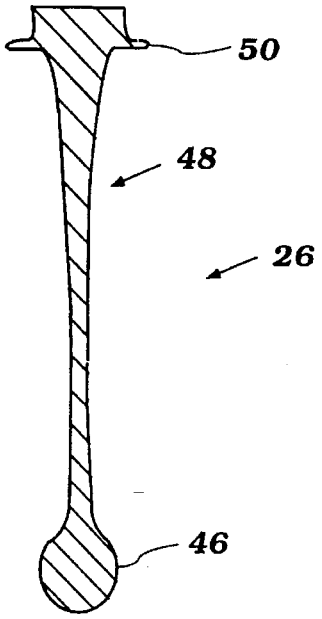
Figure 3 Prior Art
FIG. 3 is a cross-sectional view of the lower unit taken along line A'—A' of FIG. 2.

A strut 48 of the lower unit 26 attaches the nacelle 44 to an upper cavitation plate 50. As best seen in FIG. 3, the nacelle 44 and the strut 48 abruptly intersect at the front of the lower unit. The nose 46 of the nacelle has a rounded shape while the strut has a flat plate-like shape at the front end of the lower unit. A distinct transition thus forms between the nacelle nose 46 and the strut 48.

As best seen in FIG. 2, the strut includes a straight front edge 52 which extends generally perpendicular to a longitudinal axis of the nacelle 44. The position of the front edge 52 in the longitudinal direction generally coincides with the position of an apex of the nacelle nose 46.

Figure 4:
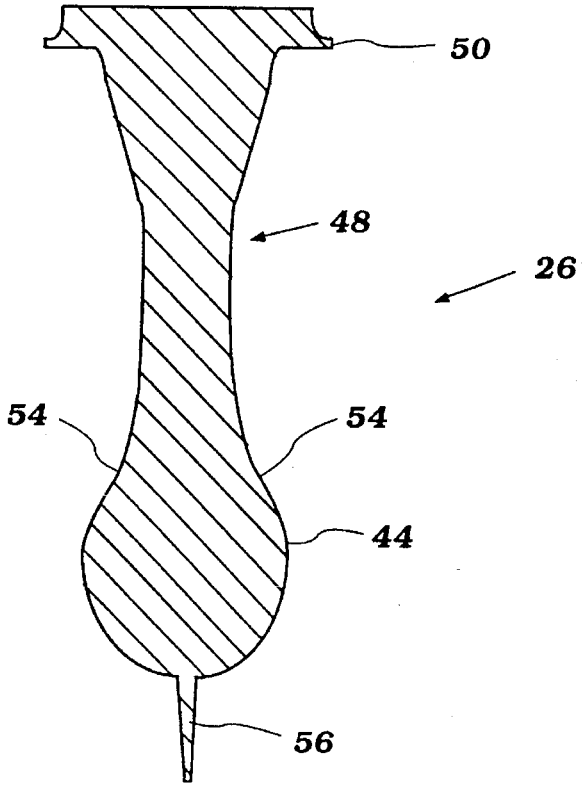
Figure 4 Prior Art
FIG. 4 is a cross-sectional view of the lower unit taken along line B'—B' of FIG. 2.
Figure 5:
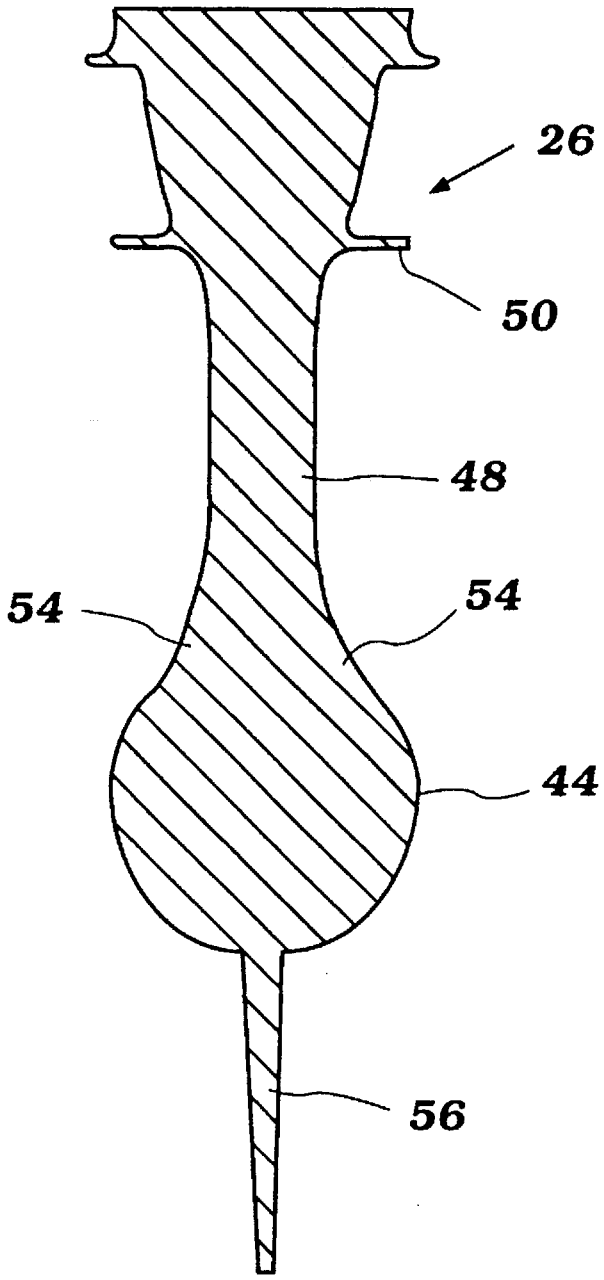
Figure 5 Prior Art
FIG. 5 is a cross-sectional view of the lower unit taken along line C'—C' of FIG. 2.

As understood from FIGS. 4 and 5, the transition between the strut 48 and the nacelle 44 of the lower unit 26 begins to smooth toward the rear of the lower unit 26. That is, arcuate fillets 54 on either side of the lower unit smoothly blend the plate-like structure of the strut into the rounded nacelle 44. Toward the rear end of the nacelle 44, the diameter of the nacelle 44 increases in order to accommodate the conventional transmission, propulsion shafts and exhaust passages. Similarly, the thickness of the strut 48 increases to strengthen the strut 48 and to house the drive shaft, associated bearings, water pump, and exhaust and oil passages, as known in the art.

As best seen in FIGS. 2 and 5, the lower unit 26 also includes a skeg 56. The skeg 56 conventionally is a thin triangularly shaped plate with its width in the vertical direction increasing toward the rear end of the lower unit 26.

As mentioned above, the outboard motor 10 and lower unit 26 are adapted to pivot about the tilt pin 34. That is, the lower unit 26 can be trimmed up from the full trim down position to a full trim up position. Line FD' of FIG. 2 represents the water level of the body of water in which outboard drive 10 is operated when the lower unit 26 lies in the full trim down position. Vector fd' represents the direction of water flow over the lower unit 26 with the lower unit 26 in this position. Line FU' represents the water level relative to the lower unit 26 when the lower unit 26 is raised to a full trim up position. And vector fu' represents the direction of water flow over the lower unit 26 in the full trim up position.

Figure 6:
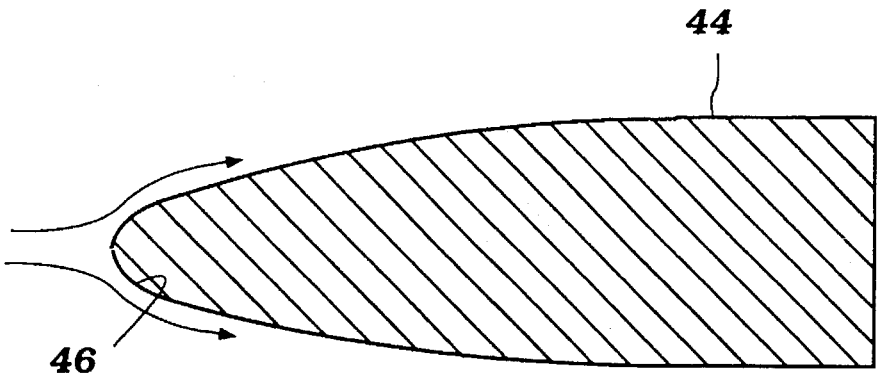
Figure 6 Prior Art
FIG. 6 is a cross-sectional view of the lower unit taken along line D'—D' of FIG. 2.

The nacelle 44 with its generally bullet-like configuration presents a streamline shape within the water flow stream when the lower unit 26 lies in its full trim down position, as well as when the lower unit 26 is trimmed up slightly. For instance, at a small trim angle $\alpha_1$, water flows over the nacelle 44 along the path represented by line D'—D'. A horizontal cross section $H_1'$ of the nacelle 44 taken along line D'—D', as seen in FIG. 6, illustrates the streamline shape of the nacelle 44 at a small trim angle $\alpha_1$.

Figure 7:
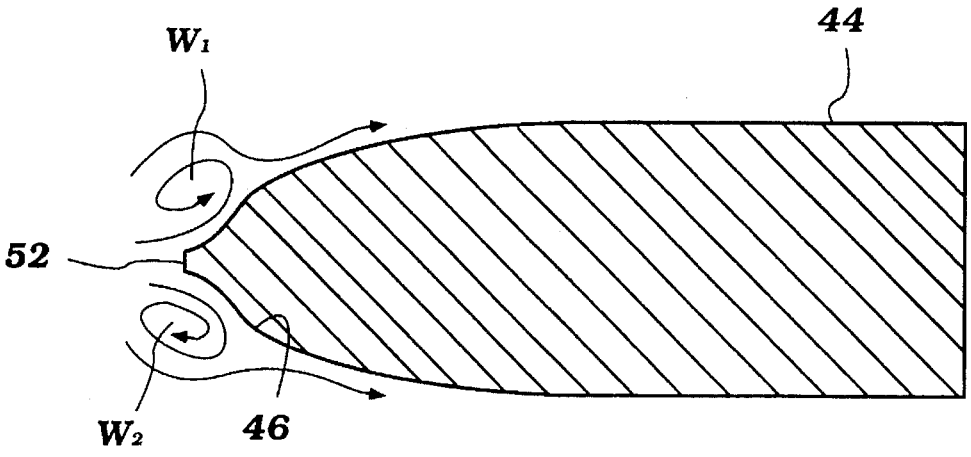
Figure 7 Prior Art
FIG. 7 is a cross-sectional view of the lower unit taken along line E'—E' of FIG. 2.

At larger trim angles, however, the conventional lower unit 26 is no longer streamline. With reference to FIG. 2, trim angle $\alpha_2$ represents a trim angle larger than trim angle $\alpha_1$ and approaching the full trim up position. Water flows over of the nacelle 44 along the path represented by line E'—E' with the nacelle 44 trimmed at angle $\alpha_2$. A horizontal cross section $H_2'$ of the nacelle 44 taken along line E'—E', as seen in FIG. 7, depicts the complicated shape formed by the leading edge 52 of the strut 48 and the nacelle 44 at the large trim angle $\alpha_2$. As illustrated, the presence of this complicated shape causes boundary layer separation within the water flow which forms wakes $W_1$, $W_2$ behind the leading edge 52 of the strut 8 which increases pressure drag on the lower unit 26.

Figure 8:
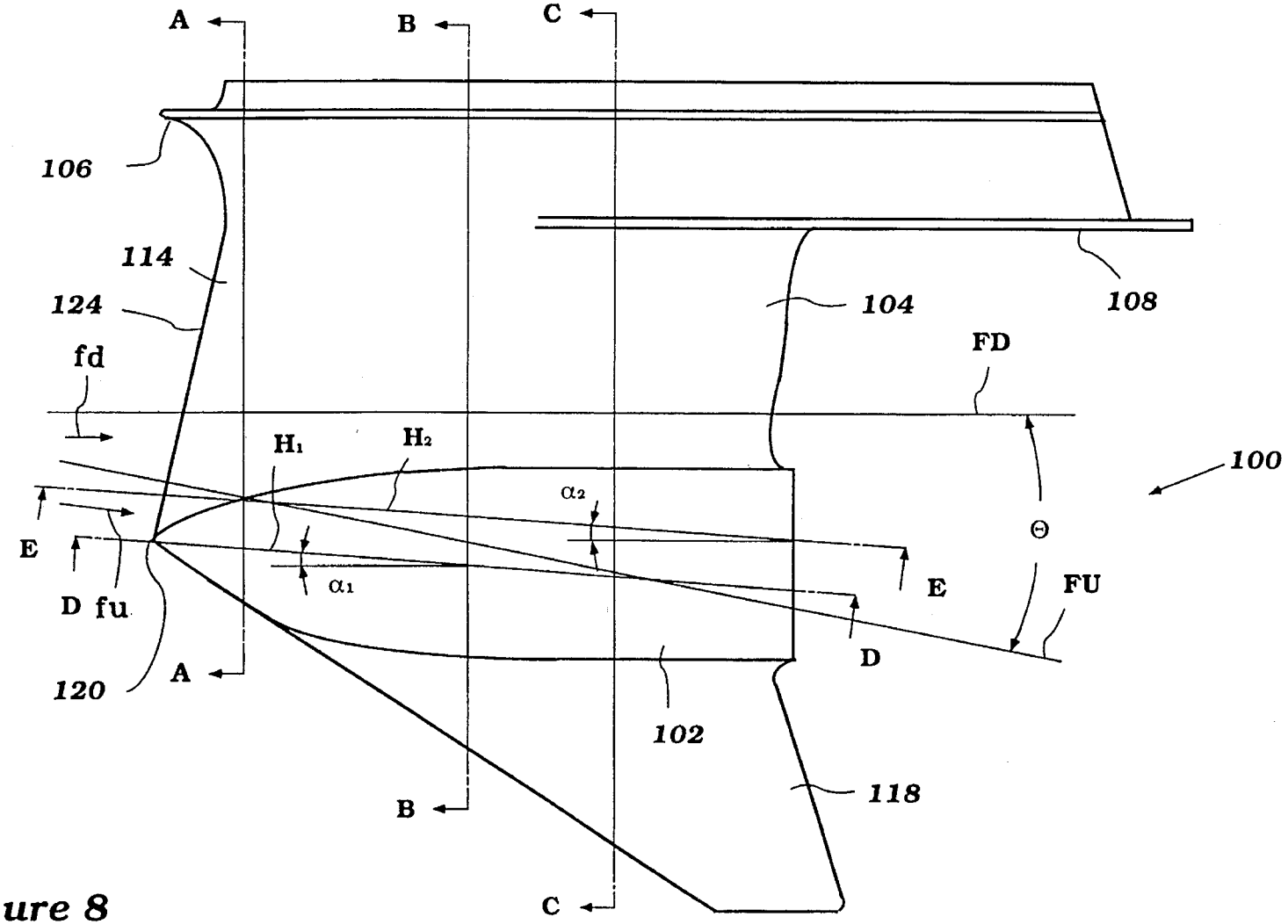
FIG. 8 is an enlarged side elevational view of a lower unit for a marine outboard drive configured in accordance with a preferred embodiment of the present invention.

FIG. 8 illustrates a lower unit 100 configured in accordance with a preferred embodiment of the present invention. As noted above, the present lower unit 100 can be incorporated into a conventional outboard drive 10 of an outboard motor, a stern drive, or a similar marine propulsion system.

Unlike prior lower unit designs, the present lower unit 100 desirably is configured so as to present a streamline shape regardless of the trim position of the lower unit 100. That is, through out the range of trim angle adjustment, the lower unit 100, and particularly the upper side of a nacelle 102 and supporting strut 104, present a streamline shape in the direction of water flow over the lower unit 26. The present lower unit 26 will now be described in detail with reference to FIGS. 8 through 13.

As seen in FIG. 8, the lower unit 100 includes overlapping cavitation plates 106, 108 positioned at its upper end. The front cavitation plate 106 surrounds the front end of the lower unit 100 and extends toward the rear end. The rear cavitation plate 108 extends beneath at least a portion of the front cavitation plate 106. The rear cavitation plate 108 also extends over the propellers 40, 42, in a conventional manner (see FIG. 1). As seen in FIG. 8, the cavitation plates 106, 108 generally lie parallel to a common axis of the propeller shafts housed within the nacelle 102.

The nacelle 102 of the lower unit 100 also houses a drive transfer mechanism which couples the drive shaft to the propeller shafts. In the illustrated embodiment, the nacelle 102 generally has an asymmetric, pointed cone-like shape of a sufficient size to house the forward-neutral-reverse transmission, associated actuation mechanism, bearings and propeller shafts of the outboard drive 10. As best seen in FIG. 8, the nacelle has an asymmetric shape relative to its longitudinal axis.

The strut 104 suspends the nacelle 102 below the cavitation plates 106, 108. The structures of the strut 104 and the nacelle 102 blend smoothly together at the front end of the lower unit 100, as discussed below. FIG. 8 schematically indicates the transition between the strut 104 and the nacelle 102 by a line representing shading on the upper side of the nacelle 102.

The nacelle 102 and strut 104 desirably present a streamline shape at least when positioned at several trim angles within the range of trim angle adjustment between the full trim up position and the full trim down position. The streamline shape inhibits boundary layer separation within the water flow over lower unit 100, thereby reducing water resistance or drag on the lower unit 100.

Figure 9:
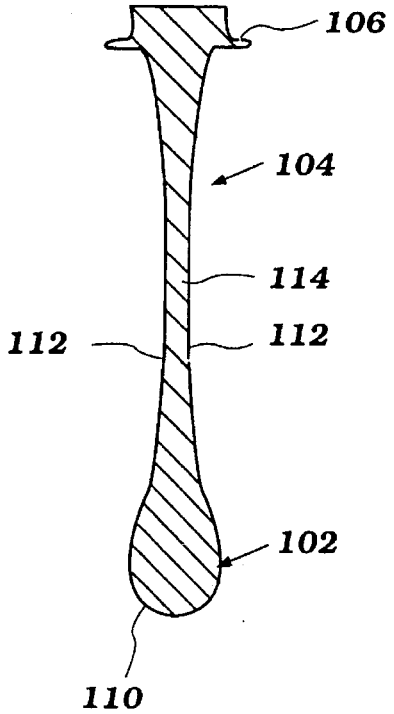
FIG. 9 is a cross-sectional view of the lower unit taken along line A'—A' of FIG. 8.
Figure 10:
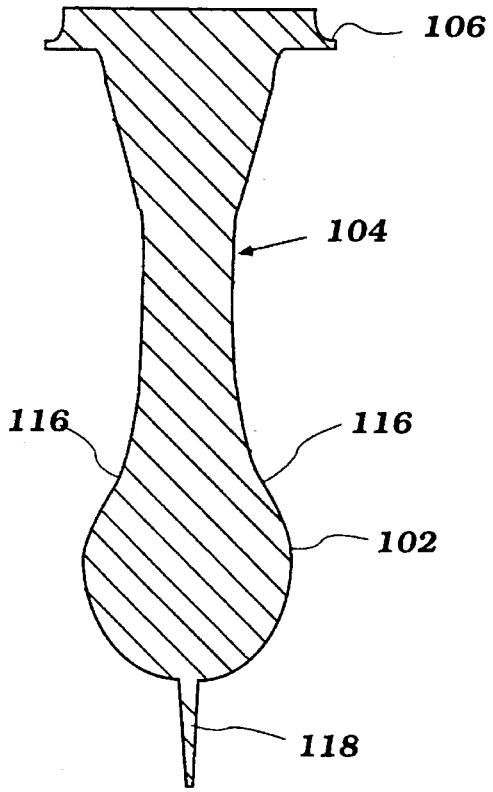
FIG. 10 is a cross-sectional view of the lower unit taken along line B'—B' of FIG. 8.
Figure 11:
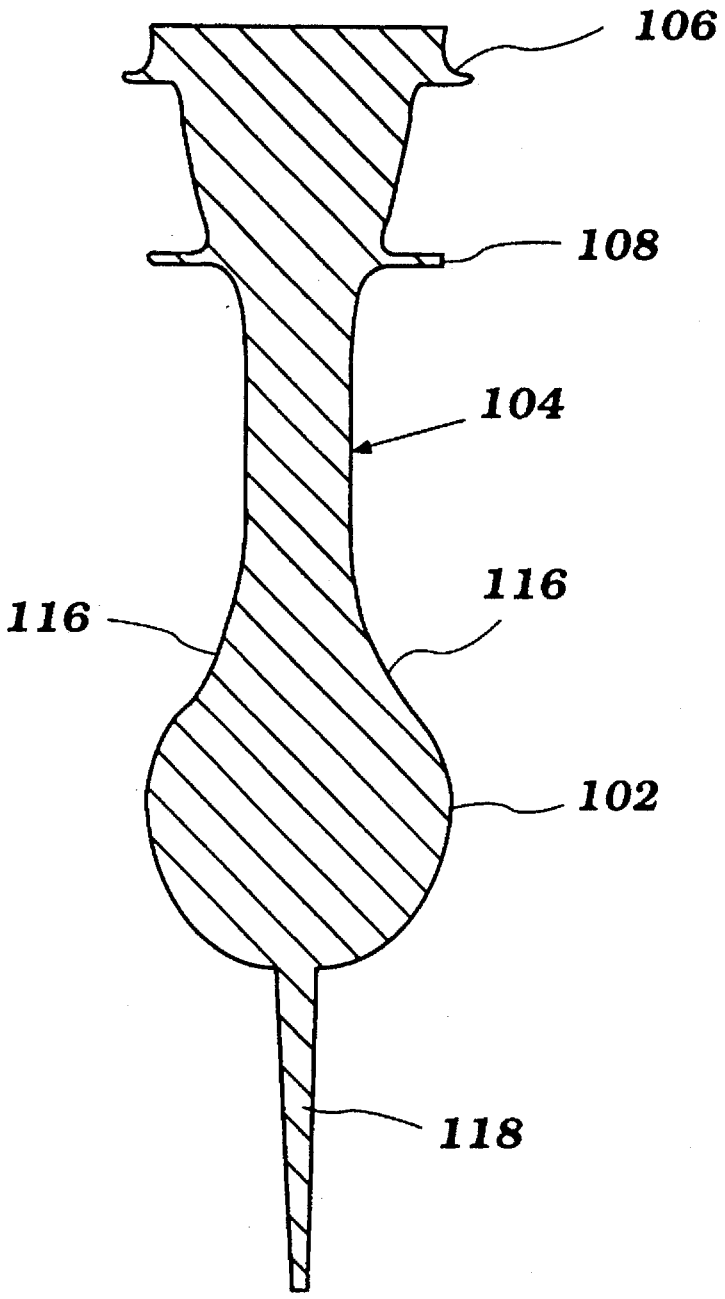
FIG. 11 is a cross-sectional view of the lower unit taken along line C'—C' of FIG. 8.

FIGS. 9 through 11 illustrates several sectional views taken through the lower unit 100 in a direction perpendicular to a longitudinal axis of the nacelle 102 (i.e., perpendicular to the axis of the propeller shafts). These views together illustrates the unique configuration of the nacelle 102 and the strut 104 of the lower unit 100 between its front and aft ends. Although FIGS. 9 through 11 illustrate the sectional view of the lower unit 100 in solid cross section for simplicity, the nacelle 102 and the strut 104 of the lower unit 100 are hollow just like conventional lower units in order to house the drive shaft, the drive transfer mechanism, the propulsion shafts, the associated bearings, the water pump, exhaust and lubrication passages, etc., of the outboard drive 10.

With reference to FIG. 9, the nacelle 102 and the strut 104 generally have a teadrop sectional shape toward the front end of the lower unit 100. At this location, the lower surface 110 of the nacelle 102 has a rounded shape which extends through an arc of greater than 180°. Each upper side of the lower rounded surface 110 of the nacelle 102 smoothly blends into a concave surface 112 which forms a side of the strut 104 at its front end 114.

Each concave surface 112 desirably has an arcuate shape defined by a constant radius. As seen in FIG. 9, the side surfaces 112 of the strut 104 converge toward each other at about a midpoint of the strut 104 in the vertical direction. The side surface 112 of the strut 104 then diverge away from each other toward the cavitation plate 106.

As understood from a comparison of FIGS. 9 and 10, the girth of the nacelle 102 and the thickness of the strut 104 of the lower unit 100 increase in the rearward direction. As seen in FIG. 10, the nacelle 102 has a more bulbous shape toward its midsection. At this location, the nacelle 102 and the strut 104 have substantially the same shape as the nacelles and struts in prior lower unit designs.

FIG. 11 illustrates a vertical section of the lower unit 100 at a point toward the rear end of the nacelle 102. Again, the nacelle 102 and the strut 104 have substantially the same shape as in prior lower unit designs. The nacelle 102 has a generally round shape. The upper side of the nacelle 102 blends smoothly into the strut 104 to form radiused fillets 116 on the sides of the strut 104.

With reference back to FIG. 8, a skeg 118 depends from the nacelle 102. The skeg 116 desirably has a shape adapted to serve as a rudder for use with the steering handle 30 (FIG. 1), as well as to protect the propellers 40, 42 (FIG. 1) positioned behind the skeg 118. In the illustrated embodiment, the skeg 118 has a conventional triangular shape, such as that described above in connection with the prior lower unit design 26.

FIG. 8 schematically illustrates the range of movement of the lower unit 100 between a full trim down position, as illustrated in FIG. 8, and a full trim up position. Line FD represents the horizontal (e.g., the water level of the body of water in which the outboard drive is operated) relative to the lower unit 100 when the lower unit 100 rests in its full trim down position. Line FU represents the horizontal (e.g., water level) relative to the lower unit 100 when the lower unit 100 is raised to its full trim up position.

Angle θ represents the range of trim angle adjustment between the full trim up position and the full trim down position. In the illustrated embodiment, angle θ generally equal about 12°.

Vector fd represents the direction of water flow over the lower unit 100 with the lower unit 100 in the full trim down position. Vector fu represents the direction of water flow over the lower unit 100 with the lower unit 100 raised to its full trim up position. Although the difference in trim angle position between the full trim down position and full trim up position desirably is about 12°, the angular difference between the water velocity vectors fd, fu is about 5° because of the upwardly-inclined direction of the water flow relative to the horizontal behind the transom when the watercraft runs at elevated speeds.

The unique shape of the front end of the nacelle 102 and the strut 104 presents a streamline shape within the water stream when the lower unit 100 rests in its full trim down position, when the lower unit 100 is raised to its full trim position, and when the lower unit 100 lies at trim positions therebetween. For instance, at a small trim angle $\alpha_1$, water flows over the nacelle 102 along the path represented by line D—D in FIG. 8. In the illustrated embodiment, line D—D passes through the vertex of the nacelle 102 due to the asymmetric shape of the nacelle 102 relative to its longitudinal axis, as seen in FIG. 8. This shape ensures that a pointed apex 120 of the nacelle 102 leads the lower unit 100 through the water even at elevated trim angles.

Figure 12:
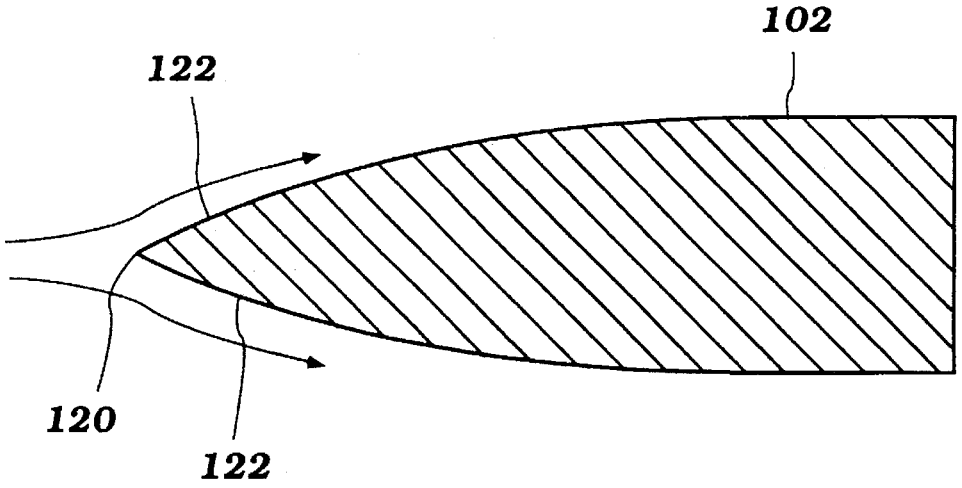
FIG. 12 is a cross-sectional view of the lower unit taken along line D'—D' of FIG. 8.

A horizontal cross section $H_1$ of the nacelle 102 taken along line D—D, as seen in FIG. 12, illustrates the streamline shape of the nacelle 102 at a small trim angle $\alpha_1$. The smooth sides 122 of the nacelle 102 diverge from the apex 120 to gradually increase the thickness of the nacelle 102. By fairing the sides 122 of the nacelle 102, the shape of the nacelle 102 inhibits fluid flow separation behind its apex 120.

The front end 114 of the strut 104 and upper side of the nacelle 102 also present a streamline shape at larger trim angles. With reference to FIG. 8, trim angle $\alpha_2$ represents a trim angle larger than trim angle $\alpha_1$ and approaching the full trim up position. Water flows over of the nacelle 102 along the path represented by line E—E in FIG. 8 with the nacelle 102 trimmed up to trim angle $\alpha_2$. For comparison purposes, $\alpha_2$ is the same in FIGS. 2 and 8, and line E—E and line E'—E' extend between similar points on the two lower units.

Figure 13:
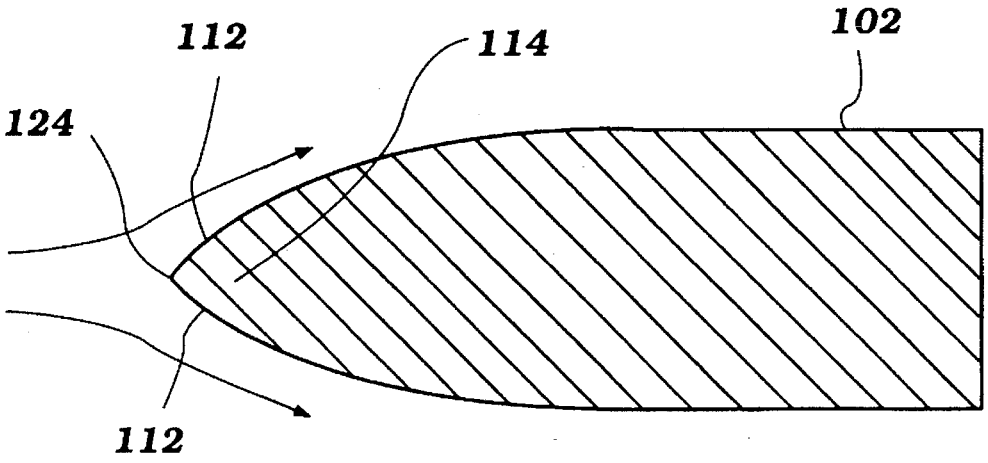
FIG. 13 is a cross-sectional view of the lower unit taken along line E'—E' of FIG. 8.

A horizontal cross section $H_2$of the nacelle 102 taken along line E—E, as seen in FIG. 13, depicts the streamline shape of the front end 114 of the strut 104 and the nacelle 102 at the larger trim angle $\alpha_2$. As understood from this figure, a leading edge 124 of the strut 104 fairs into the upper sides of the nacelle body 102. That is, each side 112 of the strut 104 smoothly blends into the corresponding side of the nacelle 102 to given the lower unit 100 a streamline shape at large trim angles.

This shape of front end 114 of the lower unit 100 inhibits the formation of a separated flow region behind the leading edge 124 of the strut 104, thereby reducing drag on the lower unit 100 as compared with prior designs. A direction comparison between the sectional views of the present lower unit 100 (FIG. 13) and the prior lower unit 100 (FIG. 7) illustrates this difference. Prior lower unit designs foster the formation of adverse pressure gradients behind the blunt front edge of the strut 104. The tapered shape of the strut front end 114 and the fairing of the strut 104 into the nacelle 102 inhibits boundary layer separation directly behind the leading edge 124, and, thus, reduces pressure drag on the lower unit 100.

The orientation of the leading g 124 also assists with the reduction of water resistance on the lower unit 100 when the lower unit is trimmed up from its full trim down position. With reference to FIG. 8, the leading edge 124 of the strut 104 desirably angles rearward, away from the nacelle 102 and toward the front cavitation plate 106. The degree by which the leading edge 124 of the strut 104 is skewed from the vertical is generally equal to about the range of the trim angle adjustment range θ. In this manner, the apex 120 of the nacelle 102 leads the lower unit 100 through the water even when the lower unit 100 is raised from its full trim down position.

Although this invention has been described in terms of a certain preferred embodiment, other embodiments apparent to those of ordinary skill in the art are also within the scope of this invention. Accordingly, the scope of the invention is intended to be defined only by the claims which follow.

What is claimed is:

1. A lower unit of a marine outboard drive capable of pivoting about a lateral axis to adjust a trim position of the outboard drive between a full-trim-up position and a full-trim-down position, said lower unit having a configuration which presents a generally streamline cross-sectional shape in a direction of water flow over the lower unit with the lower unit position in both the full-trim-up position and the full-trim-down position, said cross-sectional shape of said lower unit in both the full-trim-up position and in the full-trim-down position having a shape which extends from an apex lying along a generally sharp leading edge of the lower unit and gradually increases in width away from the apex in the direction of water flow.

2. A lower unit as in claim 1, wherein said shape of said lower unit presents the substantially streamline cross-sectional shape which extends from the sharp apex throughout a continuous range of trim angle positions between the full-trim-down position and the full-trim-up position.

3. A lower unit as in claim 1, wherein said lower unit comprises a nacelle suspended by a strut, said nacelle having a longitudinal axis.

4. A lower unit as in claim 3, wherein said nacelle includes a nose which has generally rounded lower surfaces and upper surfaces which smoothly blends into said strut such that a sectional that is perpendicular to said longitudinal axis and taken through said strut and said nacelle nose generally has a teardrop-like shape.

5. A lower unit as in claim 3, wherein said leading edge extends at an angle which is skewed relative to said longitudinal axis of said nacelle.

6. A lower unit as in claim 5, wherein said angle is within a range of trim angle adjustment between the full-trim-up position and the full-trim-down position.

7. A lower unit as in claim 5, wherein said nacelle body generally has a generally cross-sectional shape taken through its longitudinal axis.

8. A lower unit as in claim 5, wherein said leading edge of said strut is straight.

9. A lower unit as in claim 8, wherein the degree by which said leading edge of said strut is skewed relative to a transverse axis, which is perpendicular to said longitudinal axis, is about equal to an angle defined between the position of said nacelle longitudinal axis when in the full-trim-up position and the position of said nacelle longitudinal axis when in the full-trim-down position.

10. A lower unit as in claim 8, wherein said leading edge of said strut slopes upwardly and toward a rear end of said lower unit from a front end of said nacelle.

11. The lower unit as in claim 5, wherein the cross-sectional shape of the lower unit in the full-trim-up position extends from the apex along the leading edge through the strut and nacelle in the direction of water flow.

12. A lower unit as in claim 3, wherein said nacelle includes an nose defined in part by a pointed apex and side surfaces which gradually taper away from said apex in a streamline manner.

13. A lower unit as in claim 12, wherein said apex of said nacelle nose lies at a position off the longitudinal axis of said nacelle.

14. A lower unit of a marine outboard drive comprising a nacelle having a longitudinal axis defined between exterior walls, said lower unit being capable of pivoting between at least a full-trim-up position and a full-trim-down position such that a direction of water flow relative to said longitudinal axis changes as said lower unit pivots, said lower unit having a generally sharp leading edge formed by an intersection of two curved surfaces, at least a portion of each curved surface defines a portion of one of said exterior walls, said curved surfaces having gradually increasing distances therebetween away from said leading edge so as to maintain a substantially streamline shape relative to the direction of water flow as said lower unit moves between the full-trim-up position and the full-trim-down position.

15. A lower unit as in claim 14, wherein said nacelle includes a nose which has at least one generally rounded lower surface and at least one upper surface which smoothly blends into said strut such that a sectional that is perpendicular to said longitudinal axis and taken through said strut and said nacelle nose generally has a teardrop-like shape.

16. A lower unit as in claim 14, wherein said strut includes a leading edge which lies at an angle skewed relative to said longitudinal axis of said nacelle.

17. A lower unit as in claim 16, wherein said angle is within a range of trim angle adjustment between the full-trim-up position and the full-trim-down position.

18. A lower unit as in claim 16, wherein said leading edge of said strut is of straight.

19. A lower unit as in claim 14, wherein said nacelle includes a nose defined in part by a pointed apex and side surfaces which gradually taper away from said apex in a streamline manner.

20. A lower unit as in claim 14, wherein said nacelle generally has an asymmetric shape relative to the longitudinal axis of said nacelle.

21. A lower unit of a marine outboard drive which is adapted to pivot about a lateral axis to establish a trim position of the lower unit, said lower unit including a nacelle suspended by a strut into a body of water in which said outboard drive is operated, and means for inhibiting adverse pressure gradients and boundary layer separation within the water flow stream over the nacelle and behind an apex of said nacelle.

22. A lower unit as in claim 21, wherein said means comprises a generally sharp leading edge defined at least in part along a portion of the strut which extends in a generally vertical direction, said leading edge being skewed relative to a longitudinal axis of said nacelle.

23. A lower unit as in claim 22, wherein said angle is within a range of trim angle adjustment of said lower unit.

24. A lower unit as in claim 22, additionally comprising a nose on said nacelle having generally rounded lower surfaces and upper surfaces which smoothly blends into said strut such that a cross section that is perpendicular to said longitudinal axis and taken through said strut and said nacelle nose generally has a teardrop-like shape.

25. A lower unit as in claim 24, wherein said nacelle has a generally asymmetric shape relative to said longitudinal axis of said nacelle.

26. A lower unit as in claim 24, wherein said means additionally comprises an inclined leading edge of said strut which slopes away from the nose of said nacelle toward a rear end of said lower unit.

27. The lower unit as in claim 22, wherein sides surfaces of the strut smoothly fair into upper side surfaces of a body of the nacelle in the vertical direction when said lower unit is in the full-trim-down position.

28. The lower unit as in claim 22, wherein a portion of the lower unit has a cross-sectional shape, taken through said strut and an upper portion of the nacelle, which gradually diverges from one of a plurality of points along said leading edge in a direction of water flow over the lower unit.

* * * * *